US011015548B2

(12) United States Patent
Carey et al.

(10) Patent No.: US 11,015,548 B2
(45) Date of Patent: May 25, 2021

(54) SYSTEMS AND METHODS FOR REDUCING RAIL PRESSURE IN A COMMON RAIL FUEL SYSTEM

(71) Applicant: Cummins Inc., Columbus, IN (US)

(72) Inventors: David M. Carey, Greenwood, IN (US); Syed Shah Jalal, Indianapolis, IN (US); Richard J. Dudek, Columbus, IN (US); Ulf Carlsson, Columbus, IN (US); Paul Peavler, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 16/772,096

(22) PCT Filed: Dec. 14, 2017

(86) PCT No.: PCT/US2017/066390
§ 371 (c)(1),
(2) Date: Jun. 11, 2020

(87) PCT Pub. No.: WO2019/117917
PCT Pub. Date: Jun. 20, 2019

(65) Prior Publication Data

US 2021/0071612 A1 Mar. 11, 2021

(51) Int. Cl.
*F02D 41/38* (2006.01)
*F02D 41/20* (2006.01)
*F02D 41/00* (2006.01)

(52) U.S. Cl.
CPC ..... *F02D 41/3863* (2013.01); *F02D 41/0087* (2013.01); *F02D 41/20* (2013.01)

(58) Field of Classification Search
CPC ... F02D 41/3863; F02D 41/0087; F02D 41/20
(Continued)

(56) References Cited

U.S. PATENT DOCUMENTS 4,628,881 A 12/1986 Beck et al.
5,353,766 A 10/1994 Peters et al.
(Continued)

OTHER PUBLICATIONS

International Search Report and Written Opinion issued by the ISA/US, Commissioner for Patents, dated Feb. 22, 2018, for International Application No. PCT/US2017/066390; 6 pages.

*Primary Examiner* — Hai H Huynh
(74) *Attorney, Agent, or Firm* — Faegre Drinker Biddle & Reath LLP

(57) ABSTRACT

Methods and systems, using a controller (20), for performing fuel pressure control operation of an engine (12) having at least one cylinder (16) is disclosed. The controller (20) includes a fuel system control unit (42) configured to control a fuel pressure applied to at least one injector (18) of the engine (12) during a motoring condition period (412) based on a commanded pulse train duration (410). During the motoring condition period (412), no combustion occurs in the at least one cylinder (16) of the engine (12). The commanded pulse train duration is a time period during which the at least one injector (18) of the engine (12) is activated for a drain operation. The fuel system control unit (42) is configured to command the at least one injector (18), for the commanded pulse train duration during the motoring condition period (412), to release fuel from the at least one injector (18) without injecting the fuel into the at least one cylinder (16) of the engine (12).

20 Claims, 5 Drawing Sheets

(58) Field of Classification Search
USPC ..... 123/445, 456, 457, 510, 511, 514;
701/103–105, 107; 73/114.49, 114.51
See application file for complete search history.

(56) References Cited

U.S. PATENT DOCUMENTS

| | | | | |
|---|---|---|---|---|
| 5,839,412 | A | 11/1998 | Stockner et al. | |
| 5,975,053 | A | 11/1999 | Rodier | |
| 6,000,379 | A * | 12/1999 | Stockner | F02D 41/20 123/446 |
| 6,250,285 | B1 | 6/2001 | Takase | |
| 6,557,530 | B1 | 5/2003 | Benson et al. | |
| 2002/0195081 | A1 | 12/2002 | McGee et al. | |
| 2010/0313853 | A1 | 12/2010 | Morris et al. | |
| 2013/0054120 | A1 | 2/2013 | Yamada | |
| 2015/0020777 | A1 | 1/2015 | Carey et al. | |
| 2016/0017837 | A1 | 1/2016 | Carey et al. | |

* cited by examiner

SYSTEMS AND METHODS FOR REDUCING RAIL PRESSURE IN A COMMON RAIL FUEL SYSTEM

CROSS-REFERENCE TO RELATED APPLICATIONS

The present application is a national phase filing of International Patent Application No. PCT/US2017/066390, filed Dec. 14, 2017, the complete disclosure of which is expressly incorporated by reference herein.

FIELD OF THE DISCLOSURE

The present disclosure generally relates to vehicle control systems for internal combustion engines, and more specifically to fuel pressure control systems for reducing rail pressure in a common rail fuel system.

BACKGROUND OF THE DISCLOSURE

A conventional vehicle control system operatively coupled to an internal combustion engine includes an engine control system and a fuel control system, and uses various sensors to monitor engine operating conditions. In such engines, highly pressurized liquid or gaseous fuel is injected directly into a combustion chamber using an injector during or after compression so that the heat generated by compression ignites the injected fuel in a manner similar to that of diesel injection applications. A fuel pressure is reduced by the fuel control system to a level compatible with the engine control system by the time the liquid or gaseous fuel reaches the engine.

However, in conventional common rail fuel systems that employ a "leakless" injector design, it is difficult to decrease a rail pressure during a free-wheeling or motoring condition by throttling an intake flow to a high pressure pump assembly. For example, the motoring condition refers to a condition where no fuel is injected into cylinders of the engine and thus no combustion occurs in the cylinders. Because no fuel is able to escape from the rail fuel system unless injectors are injecting fuel into the cylinders, this inability to reduce the rail pressure when the injected fuel amount is zero causes various disadvantages.

One disadvantage relates to a brief period of increased noise and nitrogen oxide (NOx) emissions when the engine is transitioning from the motoring condition to an idle condition because the rail pressure is initially too high and is only able to slowly decrease due to a low fueling quantity during the idle condition. Another disadvantage is that the rail pressure remains high even when the engine is shut down, causing difficulty in servicing the fuel system. For example, the rail pressure needs to be relieved before servicing any high pressure components of the engine. Yet another disadvantage is an inability to motor the engine at a low rail pressure, which is desirable to make low-pressure fueling measurements (e.g., for an injector fueling adaption) and to provide adequate overall pressure control. Still another disadvantage is an absence of a high temperature return flow that can be recirculated through filters to avoid fuel waxing or gelling in cold weather. Accordingly, it is desirable to develop an enhanced fuel pressure control system that eliminates or alleviates one or more operational disadvantages described above.

SUMMARY OF THE DISCLOSURE

In one embodiment, the present disclosure provides a system for performing fuel pressure control operation of an engine having at least one cylinder, and includes a controller including a fuel system control unit configured to control a fuel pressure applied to at least one injector of the engine during a motoring condition period based on a commanded pulse train duration. During the motoring condition period, no combustion occurs in the at least one cylinder of the engine. The commanded pulse train duration is a time period during which the at least one injector of the engine is activated for operation. The fuel system control unit is configured to command the at least one injector, for the commanded pulse train duration during the motoring condition period, to release fuel from the at least one injector without injecting the fuel into the at least one cylinder of the engine.

In an example, the fuel system control unit is configured to determine the commanded pulse train duration based on a critical injector activation time. In a variation, the critical injector activation time represents a maximum commanded on-time period applied to the at least one injector to achieve a maximum fuel drain amount from the at least one injector without delivering the fuel to the at least one cylinder of the engine. In another variation, the fuel system control unit is configured to command the at least one injector for a commanded on-time period that is less than the critical injector activation time.

In another example, the fuel system control unit is configured to command the at least one injector for a commanded on-time period that is greater than or equal to the critical injector activation time. In a variation, the fuel system control unit is configured to generate at least one drain pulse applied to the at least one injector during the motoring condition period based on the critical injector activation time. In another variation, the at least one drain pulse has a commanded on-time period that is less than the critical injector activation time. In yet another variation, the fuel system control unit is configured to command two or more injectors simultaneously using the at least one drain pulse to increase fuel drainage from the engine. In still another variation, the fuel system control unit is configured to generate at least one test pulse applied to the at least one injector during the motoring condition period based on the critical injector activation time. In a further variation, the at least one test pulse has a commanded on-time period that is greater than or equal to the critical injector activation time.

In another embodiment, the present disclosure provides a method of performing fuel pressure control operation of an engine having at least one cylinder. The method includes receiving a signal indicating that no fuel is delivered to the at least one cylinder of the engine, detecting a motoring condition based on the received signal, controlling a fuel pressure applied to at least one injector of the engine in the motoring condition based on a commanded pulse train duration, and commanding the at least one injector, for the commanded pulse train duration, to release fuel from the at least one injector without injecting the fuel into the at least one cylinder of the engine.

In one example, the method further includes determining the commanded pulse train duration based on a critical injector activation time. In a variation, the method includes calculating the critical injector activation time that represents a maximum commanded on-time period applied to the at least one injector to achieve a maximum fuel drain amount from the at least one injector without delivering the fuel to the at least one cylinder of the engine. In another variation, the method further includes commanding the at least one injector for a commanded on-time period that is less than the critical injector activation time. In yet another variation, the method further includes commanding the at least one injector for a commanded on-time period that is greater than or equal to the critical injector activation time.

In another example, the method further includes generating at least one drain pulse applied to the at least one injector of the engine in the motoring condition based on the critical injector activation time. In a variation, the method further includes using the at least one drain pulse having a commanded on-time period that is less than the critical injector activation time. In a further variation, the method further includes commanding two or more injectors simultaneously using the at least one drain pulse to increase fuel drainage from the engine. In yet a further variation, the method further includes generating at least one test pulse applied to the at least one injector of the engine in the motoring condition based on the critical injector activation time. In still a further variation, the method further includes using the at least one test pulse having a commanded on-time period that is greater than or equal to the critical injector activation time.

While multiple embodiments are disclosed, still other embodiments of the present disclosure will become apparent to those skilled in the art from the following detailed description, which shows and describes illustrative embodiments of the present disclosure. Accordingly, the drawings and detailed description are to be regarded as illustrative in nature and not restrictive.

BRIEF DESCRIPTION OF THE DRAWINGS

The above-mentioned and other features of this disclosure and the manner of obtaining them will become more apparent and the disclosure itself will be better understood by reference to the following description of embodiments of the present disclosure taken in conjunction with the accompanying drawings, wherein.

Figure 1:
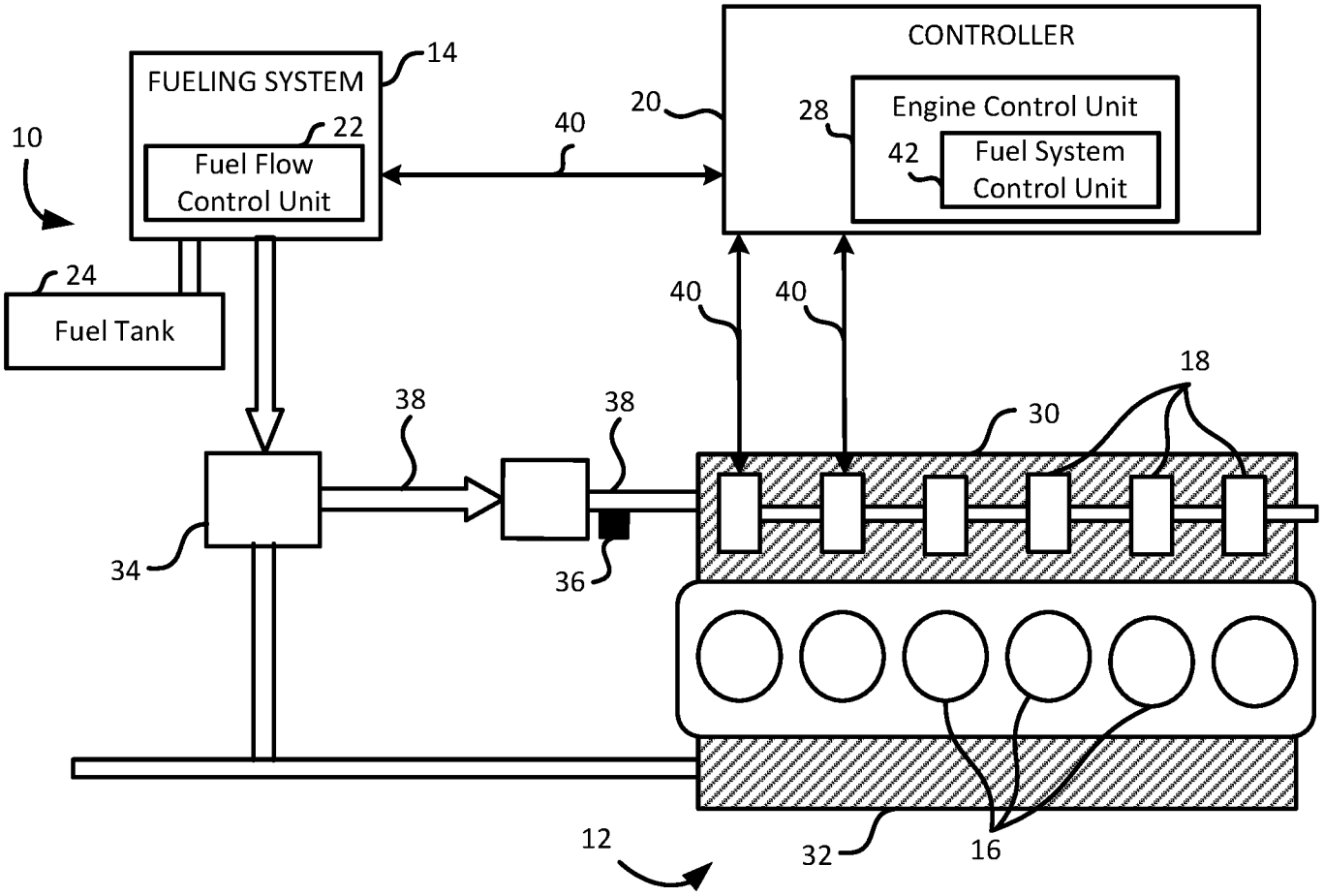
FIG. 1 is a schematic illustration of an internal combustion engine system having a fuel flow control unit and a fuel system control unit in accordance with embodiments of the present disclosure.

While the present disclosure is amenable to various modifications and alternative forms, specific embodiments have been shown by way of example in the drawings and are described in detail below. The intention, however, is not to limit the present disclosure to the particular embodiments described. On the contrary, the present disclosure is intended to cover all modifications, equivalents, and alternatives falling within the scope of the present disclosure as defined by the appended claims.

DETAILED DESCRIPTION OF THE DISCLOSURE

In the following detailed description, reference is made to the accompanying drawings which form a part hereof, and in which is shown by way of illustration specific embodiments in which the present disclosure is practiced. These embodiments are described in sufficient detail to enable those skilled in the art to practice the present disclosure, and it is to be understood that other embodiments can be utilized and that structural changes can be made without departing from the scope of the present disclosure. Therefore, the following detailed description is not to be taken in a limiting sense, and the scope of the present disclosure is defined by the appended claims and their equivalents.

FIG. 1 shows an illustrative internal combustion engine system 10 of a vehicle including an engine 12 and a fueling system 14. In this example, engine 12 is a fuel injection engine operated by liquid or gaseous fuel, such as gasoline, diesel, or gas (e.g., LPG) engines. Other suitable types of engines using gaseous fuels, such as liquefied hydrogen, propane, or other pressurized fuels, are also contemplated to suit different applications. In fuel injected engines, fuel is supplied to cylinders 16 using one or more injectors 18 in accordance with a signal provided by a controller 20. Although six cylinders 16 are shown in FIG. 1, any number of cylinders is contemplated to suit different applications.

In this example, fueling system 14 includes a fuel flow control unit 22 configured to control a fuel flow and an amount of fuel supplied from a fuel tank 24 to injectors 18. Engine 12 includes intake manifold 30 receiving fuel from fuel tank 24 via injectors 18, cylinders 16 to combust fuel, and an exhaust manifold 32 receiving combustion gases from cylinders 16 and supplying the combusted gases to a charging subsystem 34 as desired. In this example, a fuel rail pressure sensor 36 monitors a pressure level in an inlet fuel rail 38 and reports a pressure reading to an engine control unit (ECU) 28. A location of fuel rail pressure sensor 36 varies depending on applications, and the location can be any suitable position along inlet fuel rail 38 between fuel tank 24 and engine 12. For example, fuel rail pressure sensor 36 is attached to inlet fuel rail 38 to generate a fuel rail pressure signal for feedback control of fuel rail pressure by ECU 28.

In FIG. 1, controller 20 includes ECU 28 operable to produce control signals on one or more of signal paths 40 to control the operation of one or more corresponding suitably positioned engine components, such as fueling system 14. For example, ECU 28 controls directly each injector 18 via signal paths 40. For each injector 18, ECU 28 generates a drive current that has a duration equal to a desired on-time, and the start of the current command is associated with a desired start of injection (i.e., injection timing). One or more engine systems related the engine load, such as engine torque or horsepower, and other engine parameters, such as an engine speed or revolution per minute (RPM), are also controlled by ECU 28 for regulating operation of engine system 10. ECU 28 is in communication with a controller area network (CAN) or other serial bus systems for communicating with various components and sensors on engine 12 and/or within the vehicle.

ECU 28 includes a fuel system control unit 42 configured for controlling a fuel pressure applied to one or more injectors 18 during a motoring condition period based on a commanded pulse train duration. In embodiments, fuel system control unit 42 controls not only the fuel pressure (e.g., by manipulating the fuel flow control unit 22), but also controls a quantity and timing of fuel injected into each cylinder 16. The motoring condition period refers to a predetermined time period during which the motoring condition persists, e.g., no fuel is delivered to cylinders 16 and no combustion occurs in cylinders 16 of engine 12. The commanded pulse train duration refers to a time period during which one or more injectors 18 are repeatedly activated for a drain operation. Detailed descriptions of the commanded pulse train duration (410) are provided below in paragraphs relating to FIG. 4.

In some embodiments, a pressurized volume of the fuel system is comprised of injector bodies, accumulator, injector lines (e.g., between accumulator and injectors), and pump-to-accumulator lines. For example, ECU 28 controls the fuel pressure (e.g., indicated by sensor 36) in this total volume by manipulating the fuel flow control unit 22 upstream of a pump to achieve a commanded pressure level that is determined by a combustion control logic within ECU 28. Ignoring transient dynamics, the fuel pressure at all locations within the fuel system (i.e., injectors, accumulator, lines, etc.) is approximately the same. ECU 28 controls the overall system pressure, typically anywhere between 300 and 2600 bar, and it changes the command dynamically based on various different inputs and the objectives of the control logic at any given point during operation. Because the system is nominally leak-free, it is normally impossible to reduce fuel pressure unless fuel is being injected into one or more cylinders. In one example, an on-time period commanded to a single injector 18 for a normal injection ranges from 0.2 to roughly 3.0 milliseconds. The on-time period commanded to a single injector 18 to achieve only a small amount of drain flow is typically less than 0.2 milliseconds, but depends on the pressure level and type of injector being controlled.

Figure 2:
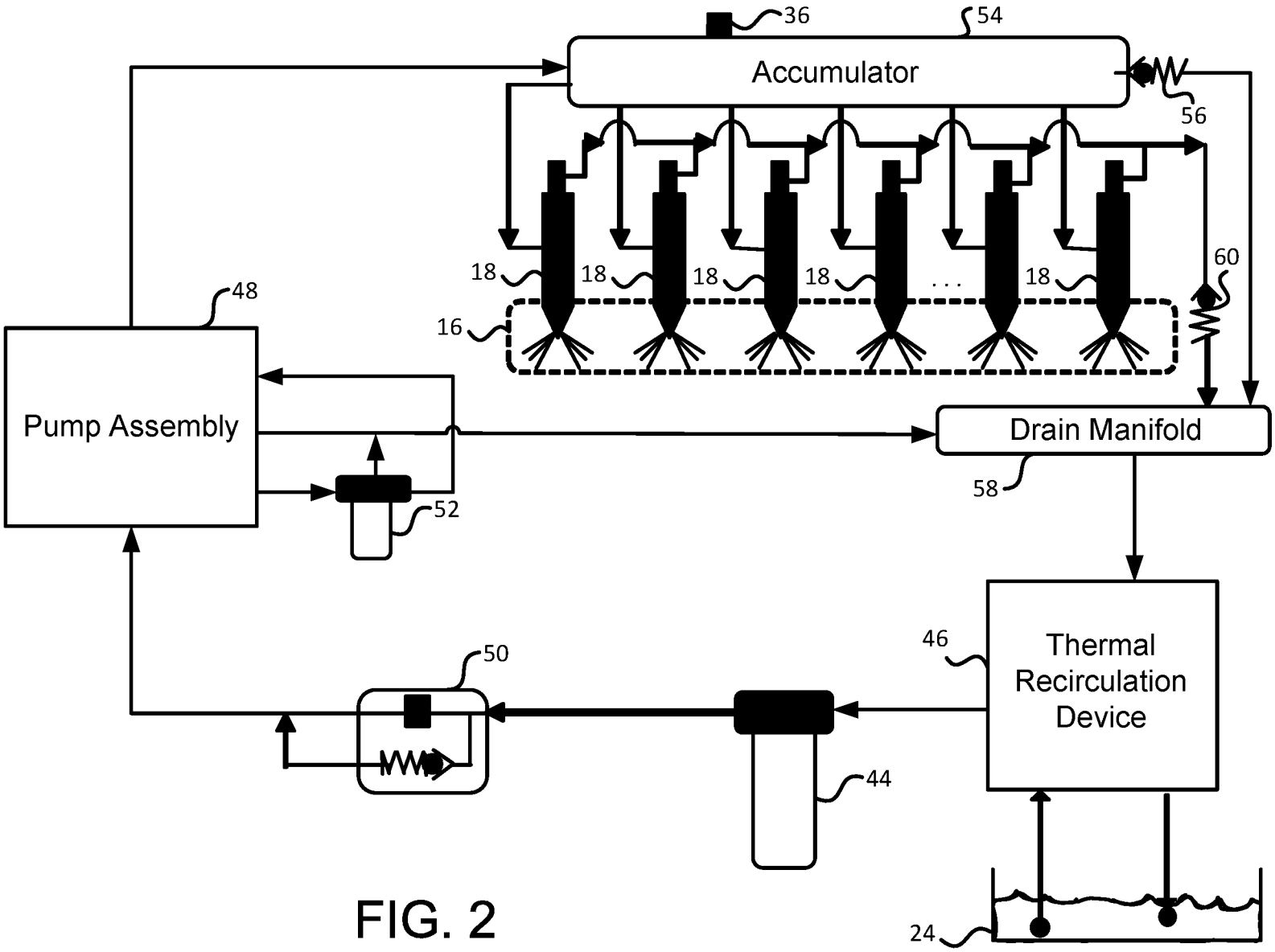
FIG. 2 is a schematic illustration of a fuel flow and pressure controlled by the fuel flow control unit and the fuel system control unit shown in FIG. 1 in accordance with embodiments of the present disclosure.

FIG. 2 shows an illustrative fuel flow controlled by fueling system 14 and fuel system control unit 42. For example, fuel flow control unit 22 of fueling system 14 is configured to control a fuel flow between fuel tank 24 and injectors 18, and fuel system control unit 42 is configured to control fuel pressure applied to one or more injectors 18. In one embodiment, fuel tank 24 is fluidly connected to a first filter 44 via a thermal recirculation device 46. First filter 44 is configured to filter fuel as it flows from fuel tank 24 to a pump assembly 48. In this configuration, fuel is delivered from fuel tank 24 to pump assembly 48 under the action of a priming pump 50, such as an electric fuel pump. In one embodiment, pump assembly 48 includes a low pressure pump and a high pressure pump operated by engine 12, and a second filter 52 is used to filter fuel as it flows between the low and high pressure pumps.

Pump assembly 48 is fluidly connected to an accumulator 54 configured to receive fuel from pump assembly 48 for disbursement of fuel to one or more injectors 18. In this example, fuel rail pressure sensor 36 monitors a pressure level in accumulator 54 and reports a pressure reading to ECU 28. In one embodiment, fuel system control unit 42 is configured to detect the motoring condition when pump assembly 48 is inactivated or no fuel is delivered to cylinders 16. In another example, fuel rail pressure control unit 42 is configured to detect the motoring condition based on a fuel amount delivered to cylinders 16. As described above, the motoring condition refers to a condition where no fuel is injected into cylinders 16 and thus no combustion occurs in cylinders 16. In another embodiment, the motoring condition is detected when a current fuel pressure level reaches a minimum fuel pressure level required for normal operation of engine 12. The minimum fuel pressure level is dynamic depending on the configuration of engine 12.

A pressure relief valve 56 is fluidly connected to accumulator 54 for relieving fuel pressure by allowing pressurized fuel to flow from accumulator 54 to a drain manifold 58 when fuel rail pressure sensor 36 indicates a pressure greater than a predetermined threshold. In one example, pressure relief valve 56 opens when an actual rail pressure exceeds a certain threshold, which is higher than a normal maximum operating pressure of the fuel system. In another example, there is no direct connection between the opening of pressure relief valve 56 and fuel rail pressure sensor 36.

During operation, fuel is delivered from accumulator 54 to one or more injectors 18 so that fuel can be injected into corresponding cylinders 16. A drain pressure regulator 60 is fluidly connected to one or more injectors 18 for allowing pressurized fuel to flow from one or more injectors 18 to drain manifold 58. For example, a regulated pressure is approximately between 5 and 35 psi, which is less than the rail pressure. Drain manifold 58 is fluidly connected to pump assembly 48, accumulator 54, and one or more injectors 18 for collecting fuel escaped from at least one of pump assembly 48, accumulator 50, and injector 18.

Figure 3:
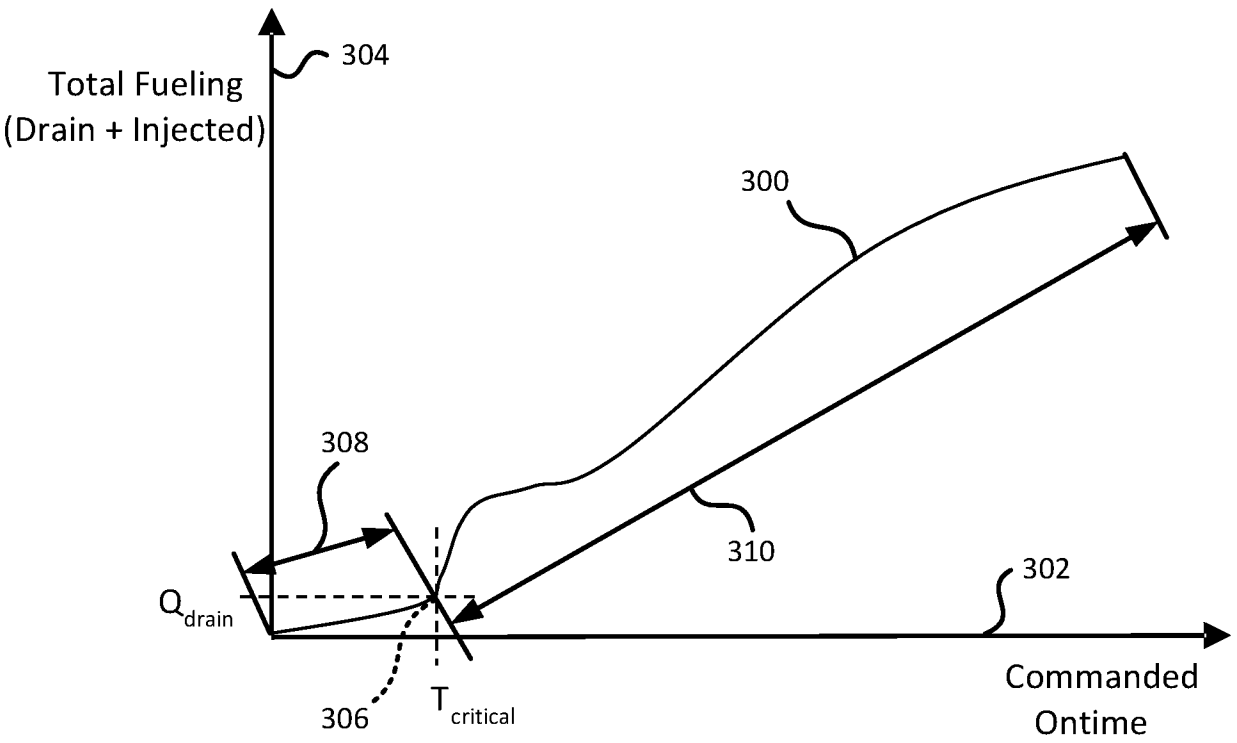
FIG. 3 is an illustrative graphical representation of determining a critical injector activation time used by the fuel system control unit in accordance with embodiments of the present disclosure.

FIG. 3 shows an illustrative graphical representation 300 of determining a critical injector activation time $T_{critical}$ and a drain amount $Q_{drain}$ for facilitating drainage of pressurized fuel from one or more injectors 18 using fuel system control unit 42. For example, fuel system control unit 42 is configured to calculate the critical injector activation time $T_{critical}$ that represents a maximum commanded on-time period which can be applied to injector 18 to achieve a maximum fuel drain amount from the same injector 18 without delivering fuel to a corresponding cylinder 16. A commanded on-time period determines whether there is sufficient time to build up the pressure and allow injector 18 to inject fuel into cylinder 16. For example, the reason that injection into cylinder 16 occurs or doesn't occur for on-time periods greater than or less than $T_{critical}$ is not because of rail pressure, but because the on-time period either is or is not sufficiently long enough to allow a needle (not shown) in injector 18 to lift off of a nozzle seat (not shown). In one example, when the on-time period is greater than $T_{critical}$, the drain flow may still happen, but when the on-time period is long enough, the needle is lifted to allow an injected flow. For example, the drain flow simultaneously occurs whenever the injected flow is occurring. Fuel system control unit 42 takes advantage of the fact that the drain flow starts before the injected flow. Thus, if injector 18 is commanded for a sufficiently short on-time, only the drain flow occurs to relieve the fuel pressure.

In one embodiment, the critical injector activation time $T_{critical}$ indirectly controls an amount of fuel pressure applied to injector 18. For example, when injector 18 is commanded to be activated less than the critical injector activation time $T_{critical}$, the pressurized fuel is drained from injector 18 to drain manifold 58 because the fuel pressure is not sufficient to inject pressurized fuel into cylinder 16. However, when injector 18 is commanded to be activated greater than or equal to the critical injector activation time $T_{critical}$, the pressurized fuel is jetted from injector 18 to the corresponding cylinder 16 because the fuel pressure is sufficient to inject pressurized fuel into cylinder 16.

In FIG. 3, a first axis 302 is associated with a commanded on-time period during which injector 18 is activated for receiving the pressurized fuel, and a second axis 304 is associated with a total fueling amount including an injected amount delivered to cylinder 16 and the drain amount $Q_{drain}$ delivered to drain manifold 58. The longer injector 18 is activated, the more the pressurized fuel is drained from injector 18 until the fuel pressure is sufficient to inject the pressurized fuel into cylinder 16 at a point 306. A first segment 308 of graphical representation 300 is associated with a fuel drainage event, and a second segment 310 of graphical representation 300 is associated with a fuel injection event. However, the fuel flow does not switch completely from the drain flow to the injected flow. As described above, the drain flow simultaneously occurs whenever the injected flow is occurring. Thus, in embodiments, the second segment 310 is also associated with the fuel drainage event.

For example, during the fuel injection event represented by second segment 310, each injector 18 is configured to inject pressurized fuel into a corresponding cylinder 16 based on the commanded on-time period (e.g., the injector activation time). As such, fuel can be injected into cylinders 16 at any operating fuel pressure by controlling the commanded on-time period. For example, when the commanded on-time period is less than or equal to the predetermined threshold, the pressurized fuel is drained from injector 18 to drain manifold 58 during the fuel drainage event represented by first segment 308, thereby reducing an overall fuel pressure in engine 12. Fuel system control unit 42 is configured to adjust the commanded on-time period for each injector 18 to facilitate transitions between the fuel drainage event and the fuel injection event. Typically, injectors 18 are considered to be actuators for controlling injected fuel quantity and timing. However, in the present disclosure, it is advantageous that injectors 18 perform as actuators for controlling the overall fuel pressure in engine 12 as well.

Figure 4:
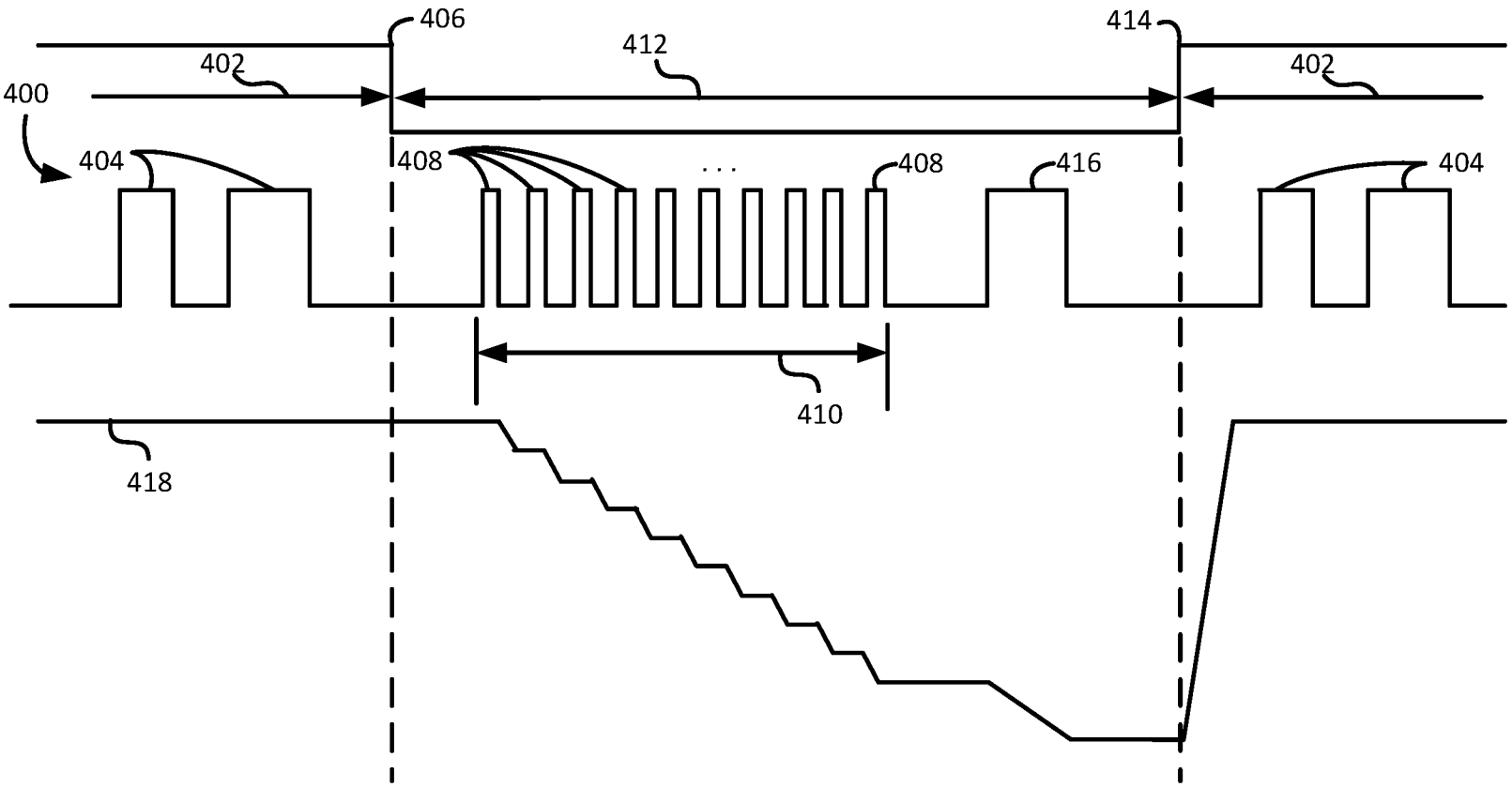
FIG. 4 is an illustrative graphical representation of controlling drain and injection pulses for each injector using the fuel system control unit in accordance with embodiments of the present disclosure.

FIG. 4 shows an illustrative graphical representation 400 of controlling drain and injection pulses for each injector 18 using fuel system control unit 42. Initially, during a normal operation period 402 of engine 12, one or more injection pulses 404 are generated by fuel system control unit 42 to deliver pressurized fuel to cylinders 16 via corresponding injectors 18. During the normal operation period 402, pump assembly 48 is activated, and pressurized fuel is delivered to cylinders 16 for subsequent combustion. Each injection pulse 404 has an activation duration greater than or equal to the critical injector activation time $T_{critical}$ so that the pressurized fuel is injected from injector 18 to the corresponding cylinder 16 rather than draining the fuel to drain manifold 58.

When fuel system control unit 42 detects a beginning 406 of a motoring condition, fuel system control unit 42 commands at least one injector 18 to initiate one or more drain pulses 408 for a time period 410, namely the pulse train duration 410. Each drain pulse 408 has an activation duration (e.g., the commanded on-time period) that is less than the critical injector activation time $T_{critical}$ so that the pressurized fuel is drained from injector 18 to drain manifold 58 rather than injecting the fuel into the corresponding cylinder 16. During the time period 410, the activation of injector 18 may refer to a condition related to being activated by fuel system control unit 42 while receiving one or more drain pulses 408. In embodiments, fuel system control unit 42 controls the time period 410 using a feedback control system (e.g., a closed-loop system) to determine how many drain pulses 408 are needed to reduce the fuel pressure in engine 12 to a desired level. Thus, the time period 410 is variable depending on a number of drain pulses 408 commanded during a motoring condition period 412. The time period 410 can include at least one drain pulse 408, but any number of drain pulses 408 is contemplated to suit the application. For example, during the motoring condition period 412, pump assembly 48 is inactivated or no fuel is delivered to cylinder 16. During the motoring condition period 412, fuel system control unit 42 commands at least one injector 18 to initiate a plurality of drain pulses 408 for the time period 410 to reduce rail pressure by draining pressurized fuel from at least one injector 18.

In one example, when the drain amount $Q_{drain}$ is 5 milligram, drain pulses 408 can be spaced as close as 1 millisecond apart, so that it would be possible to drain as much as 5,000 milligram in one second per injector 18. In another example, fuel system control unit 42 can command two injectors 18 simultaneously to increase fuel drainage from injectors 18, e.g., for a total flow rate approaching 10,000 milligram per second. With a typical common rail volume, this equates to a pressure decay rate of approximately 3,000 bar per second. A drain flow resulting from such drain operation returns to fuel tank 24 through a normal injector drain circuit of engine 12, or at least a portion of the drain flow can be recirculated to heat an incoming fuel from fuel tank 24. Other suitable drain flow configurations are also contemplated to suit different applications.

Before an end 414 of the motoring condition period 412, fuel system control unit 42 generates at least one test pulse 416 to perform a fueling measurement or any other engine maintenance. Each test pulse 416 has the activation duration greater than or equal to the critical injector activation time $T_{critical}$ so that the pressurized fuel is injected from injector 18 to the corresponding cylinder 16 for facilitating the fueling measurement. As shown in FIG. 4, it is advantageous that a current fuel rail pressure 418 of engine 12 is gradually reduced during the motoring condition period 412 down to a low rail pressure level where the fueling measurement or other engine maintenance can be adequately performed. When the motoring condition period 412 is completed at the end 414, the normal operation period 402 is resumed and injection pulses 404 are generated by fuel system control unit 42. As such, fuel rail pressure 418 is increased back to a high rail pressure level that was before the motoring condition period 412.

Figure 5:
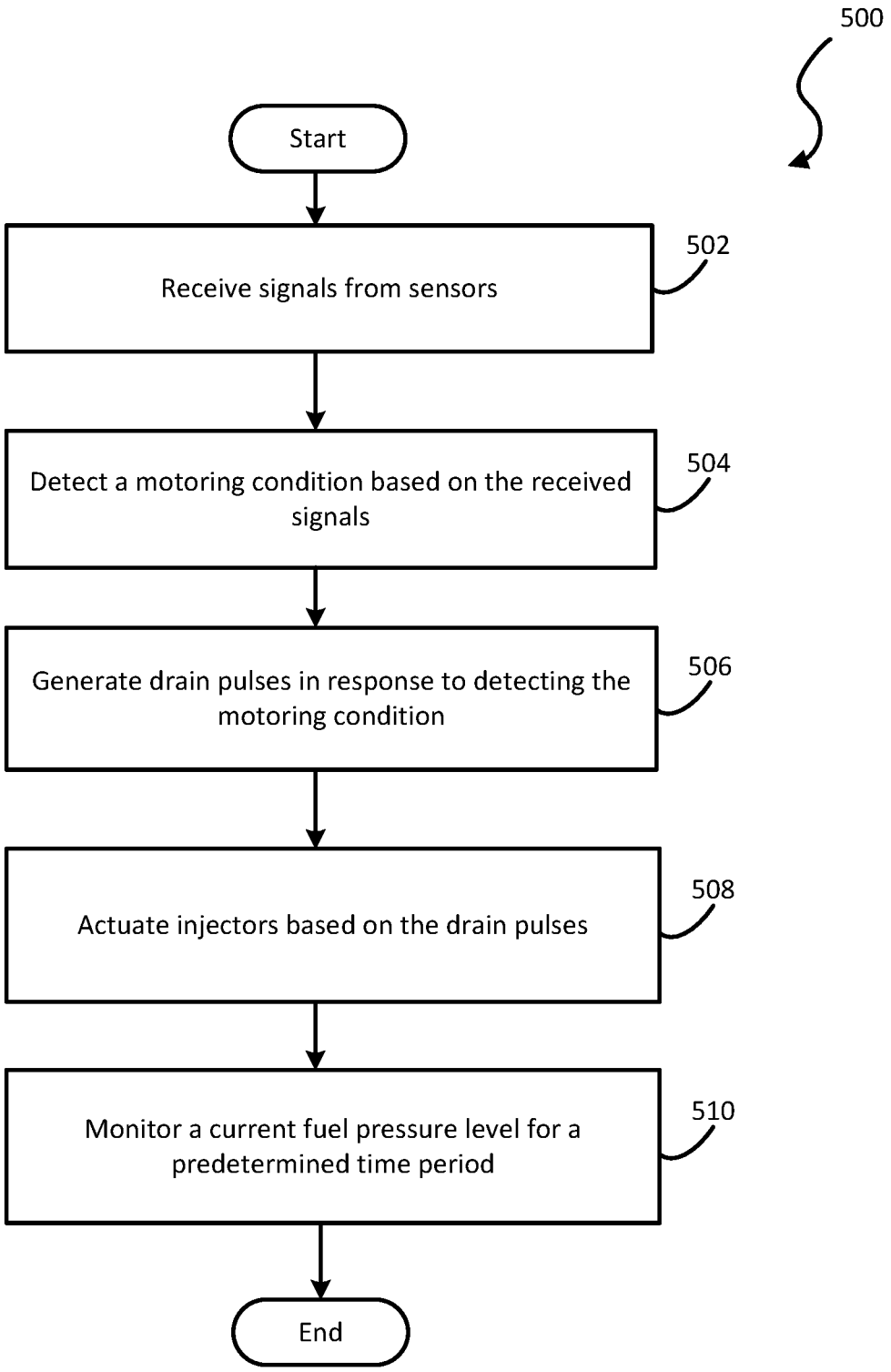
FIG. 5 is a flowchart illustrating one example of a method of performing fuel pressure operation of a vehicle using the fuel system control unit in accordance with embodiments of the present disclosure.

FIG. 5 shows an illustrative method of performing fuel pressure control operation of a vehicle using fuel system control unit 42 in accordance with embodiments of the present disclosure. It will be described with reference to FIGS. 1-4. However, any suitable structure can be employed. Although sub-blocks 502-510 are illustrated, other suitable sub-blocks can be employed to suit different applications. It should be understood that the blocks within the method can be modified and executed in a different order or sequence without altering the principles of the present disclosure.

In operation, at block 502, fuel system control unit 42 receives signals from sensors, such as fuel rail pressure sensor 36, to monitor a current fuel pressure level in inlet fuel rail 38 or fuel tank 24. Also, fuel system control unit 42 receives signals from pump assembly 48 to monitor an operation state of pump assembly 48 for determining whether a motoring condition is satisfied. At block 504, fuel system control unit 42 detects the motoring condition based on the received signals. In one embodiment, fuel system control unit 42 detects the motoring condition based on the operation state of pump assembly 48. For example, when pump assembly 48 is in an inactive operation state or a fuel amount delivered to cylinders 16 is less than a predetermined amount (e.g., zero milligram), the motoring condition is satisfied.

At block 506, fuel system control unit 42 generates at least one drain pulse 408 for a time period 410 in response to detecting the motoring condition based on the critical injector activation time $T_{critical}$. At block 508, fuel system control unit 42 selectively actuates at least one injector 18 based on the at least one drain pulse 408 for reducing rail pressure of engine 12. At block 510, fuel system control unit 42 monitors a current fuel rail pressure level 418 of engine 12 for a predetermined time period, e.g., during the motoring condition period 412 and at least a portion of the normal operation period 402. Any combinations of blocks 502-510 can be repeated as desired to perform a closed-loop fueling control operation.

As such, it is advantageous that fuel system control unit 42 has the ability to control rail pressure during the motoring condition period 412 and the normal operation period 402. Exemplary advantages include: 1) a reduced rail pressure at engine shutdown to ease fuel system servicing, 2) an enhanced ability to perform fueling measurements at a low rail pressure which improves a fuel injector adaption, 3) an improved overall rail pressure control, and 4) an additional recirculated fuel to reduce fuel waxing in cold weather operation. An additional benefit includes the ability to estimate the drain amount $Q_{drain}$ and the critical injector activation time $T_{critical}$ uniquely for each injector 18, thereby providing more precise pilot injection control, even for injectors with highly variable fueling characteristics due to wear or manufacturing tolerances. For example, fuel system control unit 42 is configured to monitor a rate of fuel pressure drop as drain pulses 408 are commanded. This improved injector control makes it possible to command small pilot injections to enhance the fuel economy and to reduce the engine noise.

Embodiments of the present disclosure are described below by way of example only, with reference to the accompanying drawings. Further, the following description is merely illustrative in nature and is in no way intended to limit the disclosure, its application, or uses. As used herein, the term "unit" refers to, be part of, or include an Application Specific Integrated Circuit (ASIC), an electronic circuit, a processor or microprocessor (shared, dedicated, or group) and/or memory (shared, dedicated, or group) that executes one or more software or firmware programs, a combinational logic circuit, and/or other suitable components that provide the described functionality. Thus, while this disclosure includes particular examples and arrangements of the units, the scope of the present system should not be so limited since other modifications will become apparent to the skilled practitioner.

Furthermore, while the above description describes hardware in the form of a processor executing code, hardware in the form of a state machine, or dedicated logic capable of producing the same effect, other structures are also contemplated. Although the sub-units, such as fuel flow control unit 22 and fuel system control unit 42, are illustrated as children units subordinate of the parent unit 14, 20, each sub-unit can be operated as a separate unit from ECU 28, and other suitable combinations of sub-units are contemplated to suit different applications. Also, although the units are illustratively depicted as separate units, the functions and capabilities of each unit can be implemented, combined, and used in conjunction with/into any unit or any combination of units to suit different applications. For example, fuel flow control unit 22 and fuel system control unit 42 can be combined and executed by engine control unit 28.

In further embodiments, the present disclosure, such as fuel system control unit 42, can be applied to any internal combustion engines using liquid or gaseous fuels like natural gas or petroleum products such as gasoline, diesel fuel, fuel oil, or the like. Moreover, other renewable fuels, such as biodiesel for compression ignition engines and bioethanol or methanol for spark ignition engines can utilize the present disclosure. It is also contemplated that the present disclosure is similarly applicable to battery electric vehicles (BEVs) operated by an electric vehicle battery or traction battery to relieve any pressure. Any secondary or rechargeable battery operated vehicles can also implement the present disclosure for the fuel pressure control operation.

It is to be understood that the above description is intended to be illustrative, and not restrictive. Many other embodiments will be apparent to those of skill in the art upon reading and understanding the above description. For example, it is contemplated that features described in association with one embodiment are optionally employed in addition or as an alternative to features described in associate with another embodiment. The scope of the present disclosure should, therefore, be determined with reference to the appended claims, along with the full scope of equivalents to which such claims are entitled.

What is claimed is:

1. A system for performing fuel pressure control operation of an engine (12) having at least one cylinder (16) comprising:

a controller (20) including a fuel system control unit (42) configured to control a fuel pressure applied to at least one injector (18) of the engine (12) during a motoring condition period (412) based on a commanded pulse train duration (410), the motoring condition period (412) during which no combustion occurs in the at least one cylinder (16) of the engine (12), the commanded pulse train duration being a time period (410) during which the at least one injector (18) of the engine (12) is activated for operation, wherein the fuel system control unit (42) is configured to command the at least one injector (18), for the commanded pulse train duration during the motoring condition period (412), to release fuel from the at least one injector (18) without injecting the fuel into the at least one cylinder (16) of the engine (12).

2. The system of claim 1, wherein the fuel system control unit (42) is configured to determine the commanded pulse-train duration based on a critical injector activation time.

3. The system of claim 2, wherein the critical injector activation time represents a maximum commanded on-time period applied to the at least one injector (18) to achieve a maximum fuel drain amount from the at least one injector (18) without delivering the fuel to the at least one cylinder (16) of the engine (12).

4. The system of claim 2, wherein the fuel system control unit (42) is configured to command the at least one injector (18) for a commanded on-time period that is less than the critical injector activation time.

5. The system of claim 2, wherein the fuel system control unit (42) is configured to command the at least one injector (18) for a commanded on-time period that is greater than or equal to the critical injector activation time.

6. The system of claim 2, wherein the fuel system control unit (42) is configured to generate at least one drain pulse (408) applied to the at least one injector (18) during the motoring condition period (412) based on the critical injector activation time.

7. The system of claim 6, wherein the at least one drain pulse (408) has a commanded on-time period that is less than the critical injector activation time.

8. The system of claim 6, wherein the fuel system control unit (42) is configured to command two or more injectors (18) simultaneously using the at least one drain pulse (408) to increase fuel drainage from the engine (12).

9. The system of claim 6, wherein the fuel system control unit (42) is configured to generate at least one test pulse (416) applied to the at least one injector (18) during the motoring condition period (412) based on the critical injector activation time.

10. The system of claim 9, wherein the at least one test pulse (416) has a commanded on-time period that is greater than or equal to the critical injector activation time.

11. A method of performing fuel pressure control operation of an engine (12) having at least one cylinder (16) comprising:

receiving a signal indicating that no fuel is delivered to the at least one cylinder (16) of the engine (12);

detecting a motoring condition based on the received signal;

controlling a fuel pressure applied to at least one injector (18) of the engine (12) in the motoring condition based on a commanded pulse train duration (410); and commanding the at least one injector (18), for the commanded pulse train duration, to release fuel from the at least one injector (18) without injecting the fuel into the at least one cylinder (16) of the engine (12).

12. The method of claim 11, further comprising determining the commanded pulse train duration based on a critical injector activation time.

13. The method of claim 12, further comprising calculating the critical injector activation time that represents a maximum commanded on-time period applied to the at least one injector (18) to achieve a maximum fuel drain amount from the at least one injector (18) without delivering the fuel to the at least one cylinder (16) of the engine (12).

14. The method of claim 12, further comprising commanding the at least one injector (18) for a commanded on-time period that is less than the critical injector activation time.

15. The method of claim 12, further comprising commanding the at least one injector (18) for a commanded on-time period that is greater than or equal to the critical injector activation time.

16. The method of claim 12, further comprising generating at least one drain pulse (408) applied to the at least one injector (18) of the engine (12) in the motoring condition based on the critical injector activation time.

17. The method of claim 16, further comprising using the at least one drain pulse (408) having a commanded on-time period that is less than the critical injector activation time.

18. The method of claim 16, further comprising commanding two or more injectors (18) simultaneously using the at least one drain pulse (408) to increase fuel drainage from the engine (12).

19. The method of claim 16, further comprising generating at least one test pulse (416) applied to the at least one injector (18) of the engine (12) in the motoring condition based on the critical injector activation time.

20. The method of claim 19, further comprising using the at least one test pulse (416) having a commanded on-time period that is greater than or equal to the critical injector activation time.

* * * * *